US008498801B2

(12) United States Patent
Nagatsuyu et al.

(10) Patent No.: US 8,498,801 B2
(45) Date of Patent: Jul. 30, 2013

(54) ENGINE START CONTROL SYSTEM AND METHOD

(75) Inventors: Toshiya Nagatsuyu, Saitama (JP); Toshifumi Osawa, Saitama (JP); Katsuhiro Utsugi, Saitama (JP)

(73) Assignee: Honda Motor Co., Ltd, Tokyo (JP)

( * ) Notice: Subject to any disclaimer, the term of this patent is extended or adjusted under 35 U.S.C. 154(b) by 558 days.

(21) Appl. No.: 12/721,028

(22) Filed: Mar. 10, 2010

(65) Prior Publication Data

US 2010/0250105 A1 Sep. 30, 2010

(30) Foreign Application Priority Data

Mar. 24, 2009 (JP) ..... 2009-072663

(51) Int. Cl.
*F02D 43/00* (2006.01)

(52) U.S. Cl.
USPC ..... 701/112; 701/113

(58) Field of Classification Search
USPC ..... 701/103, 104, 110, 112–114; 123/179.1, 123/179.4, 179.5, 179.7, 198 DB, 198 DC, 123/198 D, 198 F
See application file for complete search history.

(56) References Cited

U.S. PATENT DOCUMENTS

| | | | | |
|---|---|---|---|---|
| 7,079,941 | B2 * | 7/2006 | Tetsuno et al. | 701/112 |
| 7,210,443 | B2 * | 5/2007 | Shimokawa | 123/179.4 |
| 7,354,379 | B2 * | 4/2008 | Moriya | 477/199 |
| 7,415,955 | B2 * | 8/2008 | Matsuki et al. | 123/179.5 |
| 7,827,975 | B1 * | 11/2010 | Gibson et al. | 123/636 |
| 7,848,875 | B2 * | 12/2010 | Nakai | 701/113 |
| 7,861,683 | B2 * | 1/2011 | Saitoh et al. | 123/179.4 |
| 2005/0199209 | A1 * | 9/2005 | Shimokawa et al. | 123/179.4 |
| 2005/0228575 | A1 * | 10/2005 | Murakami et al. | 701/112 |
| 2006/0016413 | A1 * | 1/2006 | Satake et al. | 123/179.4 |
| 2007/0151536 | A1 * | 7/2007 | Yamauchi et al. | 123/179.4 |
| 2008/0091336 | A1 * | 4/2008 | Kato | 701/112 |

FOREIGN PATENT DOCUMENTS

| | | | |
|---|---|---|---|
| JP | 11-351035 | A | 12/1999 |
| JP | 2004-162543 | A | 6/2004 |
| JP | 2005-146945 | A | 6/2005 |
| JP | 2005-248921 | A | 9/2005 |
| JP | 2006-009632 | A | 1/2006 |
| JP | 3824132 | B | 7/2006 |
| JP | 2006-207565 | A | 8/2006 |
| JP | 2009-052438 | A | 3/2009 |

* cited by examiner

*Primary Examiner* — John Kwon
*Assistant Examiner* — Johnny Hoang
(74) *Attorney, Agent, or Firm* — Squire Sanders (US) LLP

(57) ABSTRACT

A 720-degree motor stage storage means for holding the result of stroke discrimination for the engine E also in the period for carrying out an idle stop control is provided. At the time of restarting the engine E from an idle stop state, a new stroke discriminating processing is not conducted, but the result of stroke discrimination stored in the 720-degree motor stage storage means is used, to thereby drive a fuel injection system and an ignition device. A stage decision unit for allocating a period of two revolutions of a crankshaft to 720-degree motor stages based on the result of stroke discrimination, a fuel injection and ignition stage correlation table having predetermined correlations of 720-degree motor stages with fuel injection stages and ignition stages, and restarting time motor stage conversion means for conversion of a 720-degree motor stage into a fuel injection stage and an ignition stage, are provided.

14 Claims, 12 Drawing Sheets

| 720-DEGREE MOTOR STAGE | FI STAGES (FUEL INJECTION) | IG STAGE (IGNITION) | 720-DEGREE MOTOR STAGE | FI STAGES (FUEL INJECTION) | IG STAGE (IGNITION) |
|---|---|---|---|---|---|
| 2 | 4 | 12 | 38 | 16 | 0 |
| 5 | 5 | 12 | 41 | 17 | 1 |
| 8 | 6 | 12 | 44 | 18 | 2 |
| 11 | 7 | 12 | 47 | 19 | 3 |
| 14 | 8 | 12 | 50 | 20 | 4 |
| 17 | 9 | 12 | 53 | 21 | 5 |
| 20 | 10 | 12 | 56 | 22 | 6 |
| 23 | 11 | 12 | 59 | 23 | 7 |
| 26 | 12 | 12 | 62 | 0 | 8 |
| 29 | 13 | 12 | 65 | 1 | 9 |
| 32 | 14 | 12 | 68 | 2 | 10 |
| 35 | 15 | 12 | 71 | 3 | 11 |

<FUEL INJECTION AND IGNITION STAGE CORRELATION TABLE>

ENGINE START CONTROL SYSTEM AND METHOD

FIELD

Embodiments of the invention relate to an engine start control system, and more particularly to an engine start control system for performing an idle stop control.

DESCRIPTION OF RELATED ART

An idle stop control is known in which at the time of momentary stop of a vehicle, such as the time of waiting for the traffic lights to change, the engine is stopped upon establishment of a predetermined condition and, thereafter, the engine is restarted in response to a throttle operation.

Japanese Patent No. 3824132 ("JP 3824132") discloses an engine start control system in which at the time of starting an idle stop control, the crankshaft is driven to rotate in reverse to a predetermined position beyond a compression top dead center, immediately after the stop of the engine, for the purpose of enhancing startability in the restarting of the engine.

Meanwhile, operation of a fuel injection system and an ignition device when starting an engine by operating a starting switch after turning on a main power supply of a vehicle is commonly carried out as follows. First, until stroke discrimination for the engine is completed, simultaneous fuel injection is conducted in which fuel injection is conducted when the engine rotating speed has reached or exceeded a predetermined value. Thereafter, fuel injection is carried out at a timing based on each predetermined crank angle, and fixed ignition is conducted every one revolution (360 degrees) of a crankshaft.

In the engine start control system, as described in JP 3824132, the crankshaft is driven to rotate in reverse to prepare for restarting. In JP 3824132, however, no investigation has been made for the method for driving the fuel injection system and the ignition device at the time of restarting the engine. For instance, at the time of the restarting, also, in the case where change-over to normal driving (computed fuel injection, computed ignition, etc.) is made upon completion of the stroke discrimination for the engine, simultaneous fuel injection and 360-degree ignition are carried out each time the engine is restarted from an idle stop condition.

SUMMARY

Embodiments of the invention provide an engine start control system in which the result of engine stroke discrimination is stored during an idle stop and the result is applied at the time of restarting the engine.

In accordance with an embodiment of the invention, an engine start control system can include an idle stop control that can be configured to automatically stop an engine upon establishment of a predetermined condition and can be further configured to restart the engine by a throttle operation at the time of starting the engine using a starting switch. A fuel injection system can perform simultaneous fuel injection until completion of a stroke discriminating process. An ignition device can ignite at a preset fixed timing every one revolution (360 degrees) of the crankshaft. After completion of the stroke discrimination, a fuel injection and an ignition control can be performed once every two revolutions (720 degrees) of the crankshaft. The engine start control system can include a storage unit (e.g., storage means) for storing, during execution of the idle stop control, the result of the stroke discrimination after starting the engine starting. At the time of restarting the engine from the idle stop control, a new stroke discriminating process is not conducted, however, the result of the stroke discrimination stored in the storage unit can be used, to thereby drive the fuel injection system and the ignition device.

In accordance with another embodiment of the invention, there is provided an engine start control system. The engine start control system can include an idle stop controlling means for stopping an engine upon establishment of a predetermined condition and configured to restart, by a throttle operation at the time of starting the engine, using a starting switch. The engine start control system can further include fuel injecting means for performing a simultaneous fuel injection until completion of a stroke discrimination, and igniting means for igniting at a preset fixed timing every one revolution of a crankshaft. Further, the engine start control system can include storing means for storing, during execution of the idle stop controlling means, a result of the stroke discrimination after starting the engine starting. After completion of the stroke discrimination, the engine start control system can be configured to perform a fuel injection and ignition control once every two revolutions of the crankshaft. At the time of restarting the engine by the idle stop controlling means, the result of the stroke discrimination stored in the storage unit can be used, instead of conducting a new stroke discrimination, thereby driving the fuel injecting means and the igniting means.

In accordance with another embodiment of the invention, there is provided a method. The method can include stopping an engine upon establishment of a predetermined condition, restarting, by a throttle operation at the time of starting the engine, using a starting switch, and performing simultaneous fuel injection until completion of a stroke discrimination. The method can further include igniting at a preset fixed timing every one revolution of a crankshaft, storing, during execution of the idle stop control, a result of the stroke discrimination after starting the engine starting, and after completion of the stroke discrimination, performing a fuel injection and ignition control once every two revolutions of the crankshaft. The method can also include, at the time of restarting the engine by the idle stop control, using the result of the stroke discrimination stored in the storage unit, instead of conducting a new stroke discrimination, thereby driving the fuel injection system and the ignition device.

In addition, in accordance with another embodiment of the invention, the engine start control system can include a stage decision unit for allocating a period of two revolutions (720 degrees) of a crankshaft to a plurality of motor stages set at regular intervals based on the result of the stroke discrimination. The engine start control system further can include a correlation table in which correlations of the motor stages with fuel injection stages to be used for driving the fuel injection system and ignition stages to be used for driving the ignition device are predetermined. Further, the engine start control system can include stage conversion means for converting the motor stage into the fuel injection stage and the ignition stage at the time of restarting the engine after the idle stop from the idle stop control.

In accordance with another embodiment of the invention, a length of one period of the motor stage can be set to be shorter than the length of one period of the fuel injection stage.

In accordance with another embodiment of the invention, the engine start control system can include an idle stop starting time rewind control unit by which the crankshaft of the engine can be rewound to a predetermined position beyond a compression top dead center when the engine is stopped by the idle stop control.

In accordance with another embodiment of the invention, the motor can include an alternating-current generator (ACG) starter motor functioning as both a starter motor and an ACG.

In accordance with another embodiment of the invention, at the time of restarting the engine (E) from the idle stop control, a fuel injection and ignition control can be performed once every two revolutions (720 degrees) of the crankshaft.

In accordance with another embodiment of the invention, the stroke discriminating process can be carried out by discriminating an intake stroke and a combustion stroke from each other based on the fact that a PB value detected by a PB sensor is lowered due to a manifold air pressure in the intake stroke and, alternatively, is raised due to the non-execution of intake in the combustion stroke after 360-degree rotation.

According to an embodiment of the invention, the engine start control system can include the storage means for holding, during execution of the idle stop control, the result of the stroke discrimination after starting the engine. At the time of restarting the engine from the idle stop control, a new stroke discriminating processing is not conducted, however, the result of the stroke discrimination stored in the storage means can be used to drive the fuel injection system and the ignition device. Therefore, at the time of restarting the engine from the idle stop, it may be unnecessary to perform engine stroke discrimination, and an optimum fuel injection and ignition control can be carried out from the beginning. Accordingly, startability at the time of restarting the engine can be enhanced. Additionally, the non-execution of simultaneous fuel injection in conjunction with the idle stop effect can further improve fuel economy.

According to an embodiment of the invention, the engine start control system can include a stage decision unit for allocating a period of two revolutions (720 degrees) of a crankshaft to a plurality of motor stages set at regular intervals based on the result of the stroke discrimination. A correlation table in which correlations of the motor stages with fuel injection stages to be used for driving the fuel injection system and ignition stages to be used for driving the ignition device can be predetermined. The engine start control system can also include stage conversion means for converting the motor stage into the fuel injection stage and the ignition stage at the time of restarting the engine after the idle stop from the idle stop control. Accordingly, fuel injection stages and ignition stages can be set, for example, by use of 720-degree motor stages obtained by allocating the period of two revolutions (720 degrees) of the crankshaft to a total of stages including Stages #0 to #71, with each stage being 10 degrees long.

According to an embodiment of the invention, the length of one period of the stage can be set to be shorter than the length of one period of the fuel injection stage. Accordingly, the length of the fuel injection stage can be finely set by use of short-period stages.

According to an embodiment of the invention, the engine start control system can include an idle stop starting time rewind control unit by which the crankshaft of the engine can be rewound to a predetermined position beyond a compression top dead center when the engine is stopped by the idle stop control. Therefore, startability at the time of restarting the engine from the idle stop state can be further enhanced.

According to an embodiment of the invention, the motor can be an ACG starter motor functioning as both a starter motor and an AC generator. Therefore, both starting of the engine and power generation after starting the engine can be carried out using a single motor provided on the crankshaft.

According to an embodiment of the invention, at the time of restarting the engine from the idle stop control, a fuel injection and ignition control can be performed once every two revolutions (720 degrees) of the crankshaft. Therefore, even in the case of restarting the engine, an optimum fuel injection and ignition control can be performed from the beginning, whereby fuel economy can be further improved.

According to an embodiment of the invention, the stroke discriminating processing can be carried out by discriminating an intake stroke and a combustion stroke from each other based on the fact that a PB value detected by a PB sensor can be lowered due to a manifold air pressure in the intake stroke and, alternatively, can be raised due to the non-execution of intake in the combustion stroke after 360-degree rotation. Therefore, the stroke discrimination for a four-cycle engine can easily be carried out based on the value of an output from a PB sensor (e.g., intake pressure sensor).

DETAILED DESCRIPTION OF EMBODIMENTS

Figure 1:
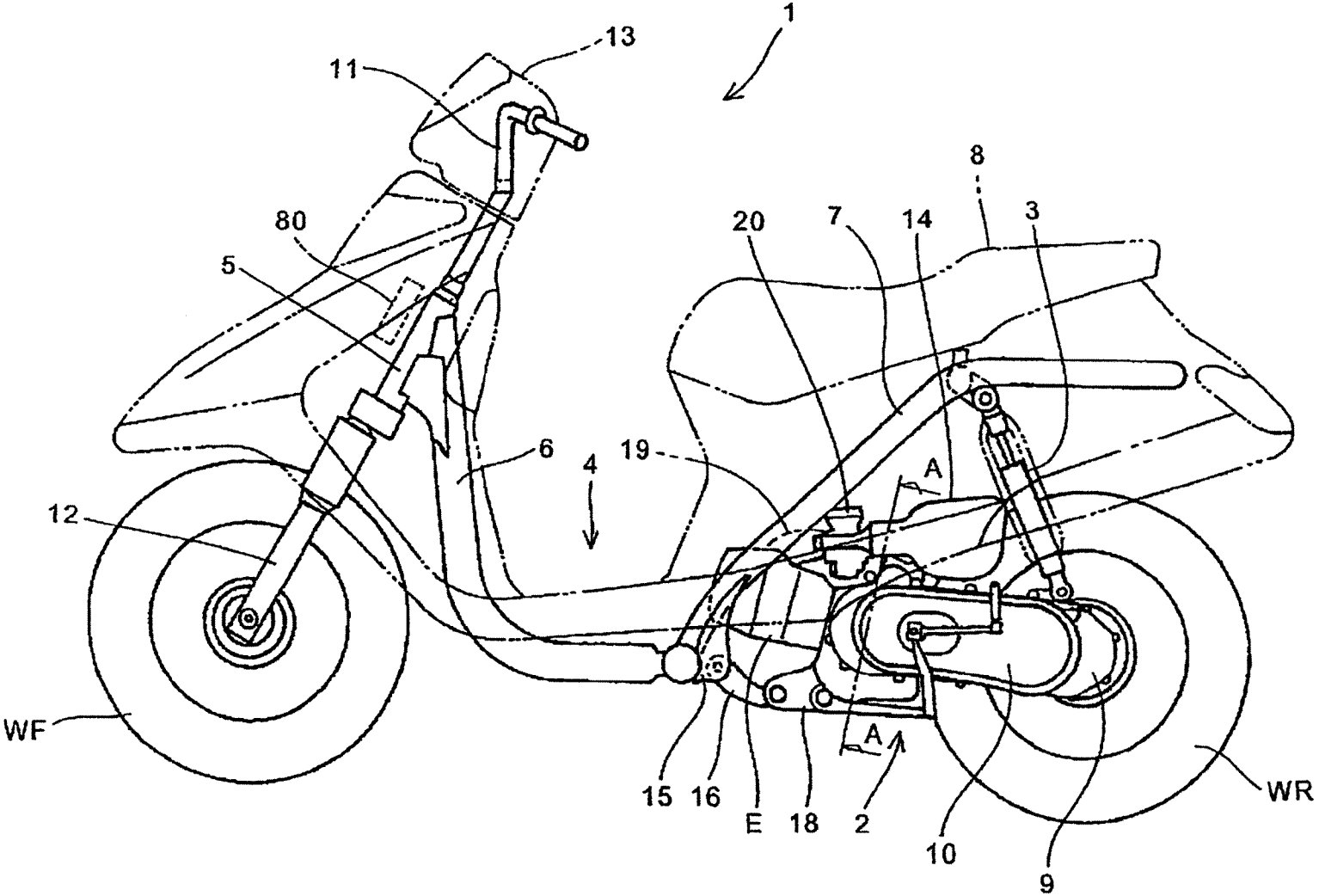
FIG. 1 is a side view of a motor scooter-type motorcycle to which an engine start control system has been applied, in accordance with an embodiment of the invention.

Embodiments of the invention will be described in detail below referring to the drawings. FIG. 1 is a side view of a motor scooter-type motorcycle 1 to which an engine start control system, in accordance with an embodiment of the invention, has been applied. A front part and a rear part of a vehicle body can be connected to each other through a low-floor-type floor part 4. A body frame can generally include a down tube 6 and a main pipe 7. A seat 8 can be disposed on the upper side of the main pipe 7.

A handle bar 11 can be rotatably supported by a head pipe 5, and can extended upwards. On the lower side of the head pipe 5, a front fork 12 for rotatably supporting a front wheel WF can be mounted. A handle cover 13 functioning as an instrument panel can be mounted on an upper part of the handle bar 11. In addition, an ECU 80, as the engine start control system, can be disposed on the front side of the head pipe 5.

A bracket 15 can be projectingly provided at a position corresponding to the rear end of the down tube 6 and a rising part of the main pipe 7. A hanger bracket 18 of a swing unit 2 can be swingably supported on the bracket 15 through a link member 16.

A four-cycle, single-cylinder engine E can be disposed at a front part of the swing unit 2. A continuously variable transmission 10 can be disposed on the rear side of the engine E, and a rear wheel WR can be rotatably borne on an output shaft of a speed reducing mechanism 9. A rear shock absorbing unit 3 can be interposed between the upper end of the speed reducing mechanism 9 and a bent part of the main pipe 7. An air cleaner 14 and a throttle body 20 of a fuel injection system connected to an intake pipe 19 extended from the engine E can be disposed on the upper side of the swing unit 2.

Figure 2:
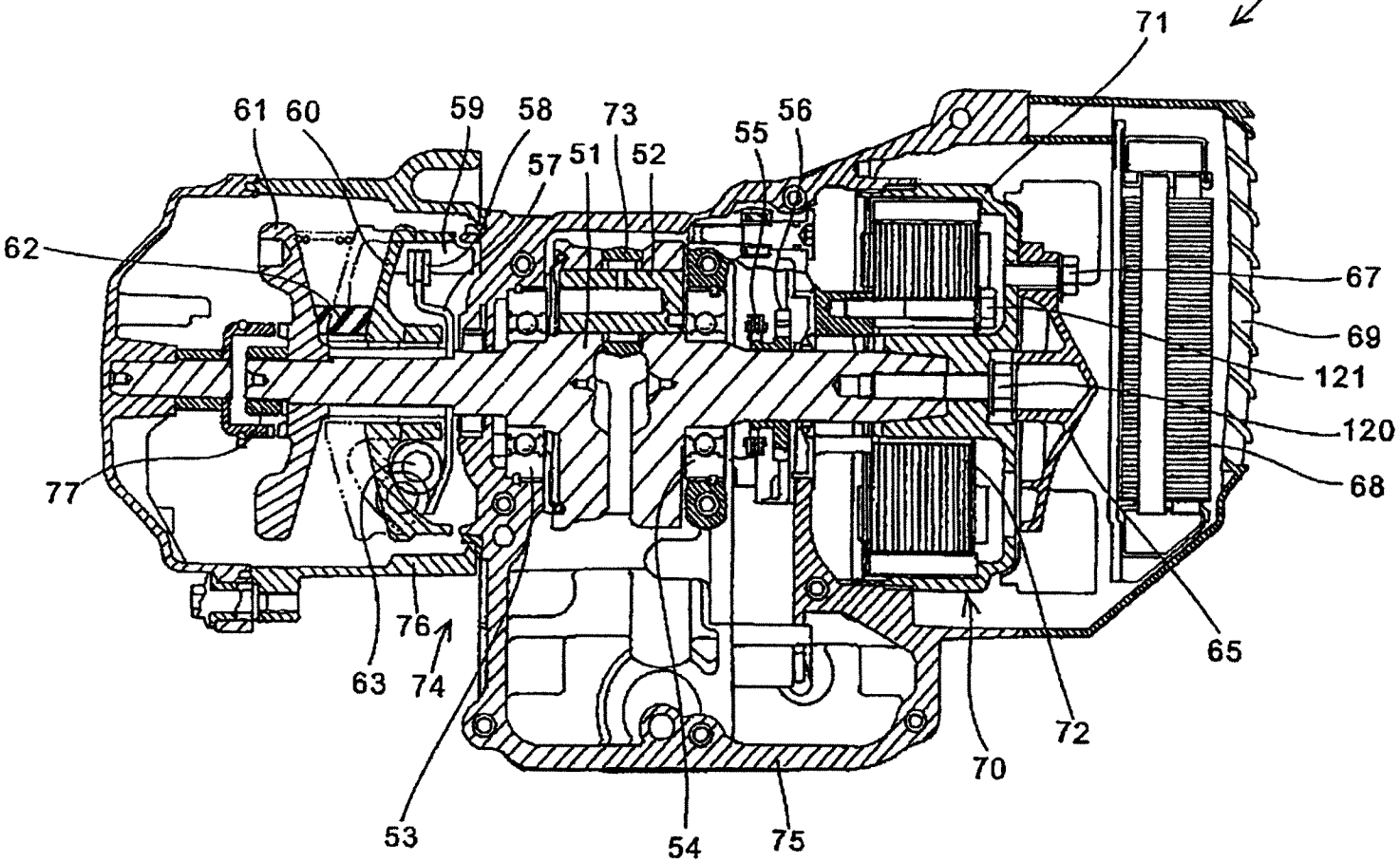
FIG. 2 is a sectional view taken along line A-A of FIG. 1, in accordance with an embodiment of the invention.

FIG. 2 is a sectional view taken along line A-A of FIG. 1, in accordance with an embodiment of the invention. The swing unit 2 can include a crankcase 74 that can include a right case 75 on the right side of the motorcycle in the width direction and a left case 76 on the left side of the motorcycle in the width direction. A crankshaft 51 can be rotatably borne on bearings 53 and 54 fixed to the crankcase 74. A connecting rod 73 can be connected to the crankshaft 51 through a crank pin 52.

The left case 76 can function as a transmission case, and a belt drive pulley can include a movable-side pulley half 60 and a fixed-side pulley half 61 and can be mounted to a left end portion of the crankshaft 51. The fixed-side pulley half 61 can be fastened to the left end portion of the crankshaft 51 by a nut 77. In addition, the movable-side pulley half 60 can be spline fitted to the crankshaft 51 to be movable in the axial direction. A V-belt 62 can be wrapped around both the pulley halves 60 and 61.

On the right side of the movable-side pulley half 60, a ramp plate 57 can be fixed to the crankshaft 51. A slide piece 58 mounted to an outer peripheral end portion of the ramp plate 57 can be engaged with a ramp plate sliding boss part 59 formed in the axial direction at the outer peripheral end of the movable-side pulley half 60. In addition, the ramp plate 57 can be provided at its outer peripheral portion with a taper surface inclined toward the movable-side pulley half 60 as one goes radially outwards. A plurality of weight rollers 63 can be contained between the taper surface and the movable-side pulley half 60.

When the rotating speed of the crankshaft 51 increases, a centrifugal force can cause the weight rollers 63 to move radially outwards. This can cause the movable-side pulley half 60 to move toward the left in the figure to move closer to the fixed-side pulley half 61. As a result, the V-belt 62 clamped between both the pulley halves 60 and 61 can be moved radially outwards, whereby the wrap radius thereof can be enlarged. On the rear side of the swing unit 2, a driven pulley (not shown) can be provided on which the wrap radius of the V-belt 62 varies, corresponding to the pulley halves 60, 61. A driving force of the engine E can be automatically regulated by the belt transmission mechanism, and can be transmitted to the rear wheel WR through a centrifugal clutch (not shown) and the speed reducing mechanism 9 (see FIG. 1).

An ACG starter motor 70 can include a starter motor and an AC generator in combination and can be disposed in the inside of the right case 75. The ACG starter motor 70 can include an outer rotor 71 fixed to a tip taper part of the crankshaft 51 by a mounting bolt 120, and a stator 102 disposed on the inner side of the outer rotor 71 and mounted to the right case 75 by a mounting bolt 121. A radiator 68 and a cover member 69 formed with a plurality of slits can be mounted to the right side, in the figure, of an air fan 65 fixed to the outer rotor 71 by a mounting bolt 67.

A sprocket 55 around which a cam chain for driving a camshaft (not shown) is wrapped can be fixed to the crankshaft 51, between the ACG starter motor 70 and the bearing 54. Besides, the sprocket 55 can be formed integrally with a gear 56 for transmitting power to a pump (not shown) for circulating an oil.

Figure 3:
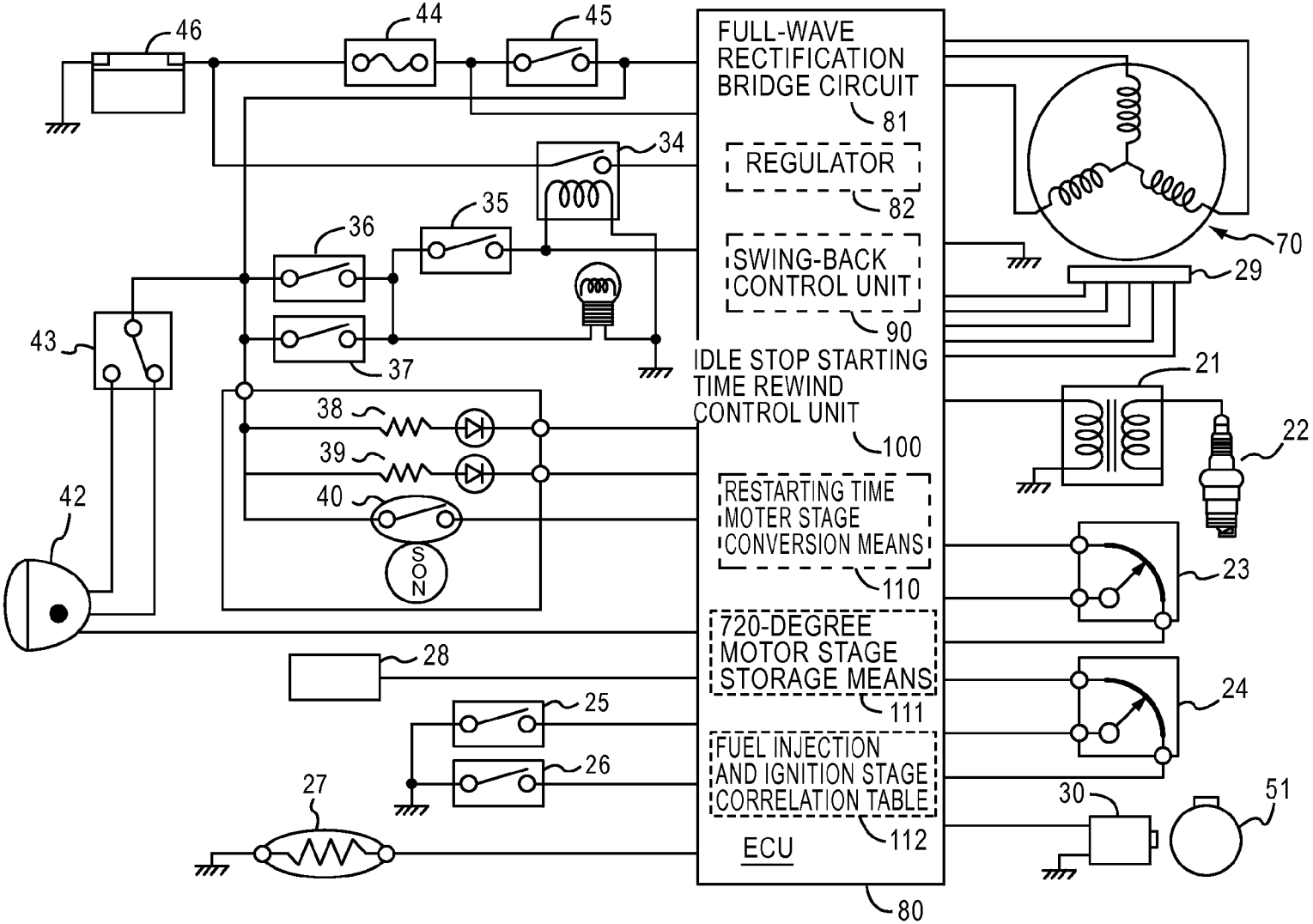
FIG. 3 is a block diagram of a control system for an ACG starter motor, in accordance with an embodiment of the invention.

FIG. 3 is a block diagram of a control system for the ACG starter motor 70, in accordance with an embodiment of the invention. The same reference symbols used above for FIGS. 1 and 2 denote those parts which are the same as, or equivalent to, the above-mentioned parts. The ECU 80 can include a full-wave rectification bridge circuit 81 for full-wave rectification of a three-phase alternating current of the ACG starter motor 70, and a regulator 82 for limiting an output of the full-wave rectification bridge circuit 81 to a planned regulatory voltage (regulator operation voltage, for example, 14.5 V). The ECU 80 can further include a swing-back control unit 90 for reversely rotating the crankshaft 51 to a predetermined position at the time of starting the engine, and an idle stop starting time rewind control unit 100 for reversely rotating the crankshaft 51 to a predetermined position at the time of starting an idle stop. Further, the ECU 80 can include restarting time motor stage conversion means 110 for setting fuel injection and ignition stages at the time of restarting the engine from an idle stop state, 720-degree motor stage storage means 111 for storing 720-degree motor stages as crankshaft positions at the time of starting the idle stop, and a fuel injection and ignition stage correlation table 112 used for setting the fuel injection and ignition stages. The above-mentioned control system will be described in detail later.

A fuel injection system 28, a motor angle sensor 29, an ignition coil 21, a throttle position sensor 23, a fuel sensor 24, a seat switch 25 for detecting the seated state of a rider, an idle stop control enable switch 26, a cooling water temperature sensor 27, and an ignition pulser 30 can be connected to the ECU 80, and detection signals from these parts can be inputted to the ECU 80. A spark plug 22 can be connected to a secondary side of the ignition coil 21.

Furthermore, a starter relay 34, a starting switch 35, stop switches 36, 37, a stand-by indicator 38, a fuel indicator 39, a vehicle speed sensor 40, and a head light 42 can be connected to the ECU 80. The head light 42 can include a dimmer switch 43. The above-mentioned component parts can be supplied with electric power from a battery 46 through a main fuse 44 and a main switch 45.

Figure 4:
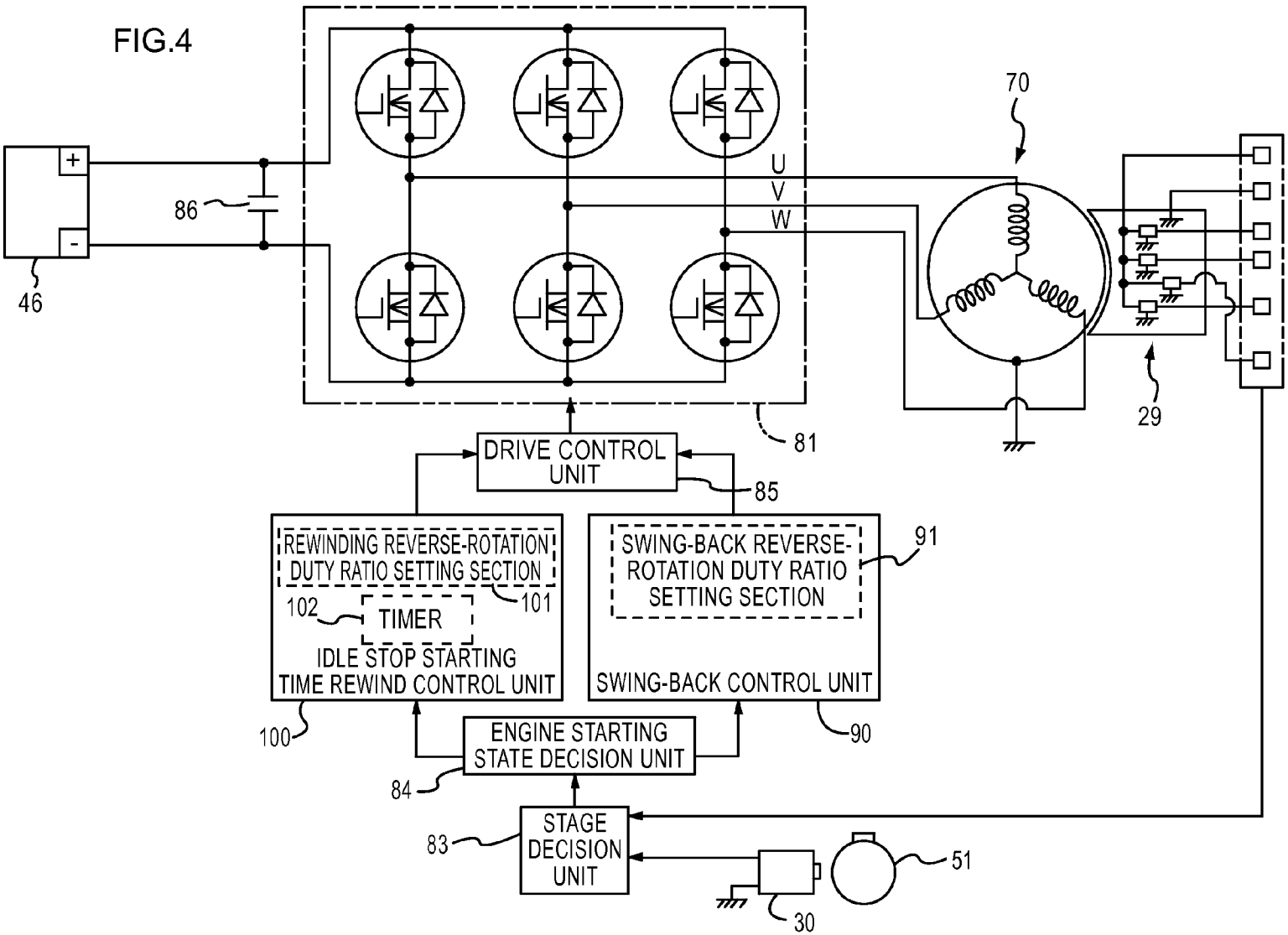
FIG. 4 is a block diagram illustrating a major part in an electronic control unit (ECU) for drive control of the ACG starter motor, in accordance with an embodiment of the invention.

FIG. 4 is a block diagram illustrating the configuration of a major part in the ECU 80 for drive control of the ACG starter motor 70, in accordance with an embodiment of the invention. The full-wave rectification bridge circuit 81 can be connected in parallel with three sets of power FETs, whereby each set can include two power FETs connected in series. A smoothing capacitor 86 can be arranged between the battery 46 and the full-wave rectification bridge circuit 81.

A stage decision unit 83, based on output signals from the motor angle sensor 29 and the ignition pulser 30, can be configured to divide two revolutions of the crankshaft 51 into 72 stages (720-degree motor stages) including Stages #0 to #71, and further can be configured to determine the current stage. Incidentally, in the period after the starting of the engine and until stroke discrimination (decision of the obverse and reverse of two revolutions of the crankshaft), based on an output from a PB sensor and the like, is completed, the stage decision can be carried out using 360-degree motor stages obtained by dividing one revolution of the crankshaft 51 into 36 stages including Stages #0 to #35. The ignition pulser 30 can be provided as one body with the motor angle sensor 29 of the ACG starter motor 70, and can be configured to detect the rotational angle of the ACG starter motor 70 mounted to the crankshaft 51.

The ECU (engine start control system) 80, in accordance with an embodiment of the invention, can perform an "engine starting time swing-back control" in which, at the time of starting the engine E by operating the starting switch 35 (see FIG. 3) starting from the condition where the engine E is stopped, the engine E can be reversely rotated to a predetermined position. Hence, the engine E can be swung back to the predetermined position, and thereafter the engine E can be rotated in a normal direction, whereby an approach-run period can be prolonged until coming to a compression top dead center, whereby the rotating speed of the crankshaft 51 at the time of crossing the compression top dead center for the first time can be enhanced. Accordingly, the engine starting time swing-back control, in accordance with an embodiment of the invention, makes it possible to enhance the startability at the time of starting the engine by the starting switch 35.

In addition, the ECU 80 can perform an idle stop control in which, at the time of a stop of the vehicle, such as the time of waiting for the traffic lights to change, the engine can be stopped when a predetermined condition is satisfied. The predetermined condition for starting the idle stop can be, for example, the lapse of a predetermined period of time in the presence of such a condition that the idle stop control enable switch 26 is ON, that the seating of the rider is detected through the seat switch 25, that the vehicle speed detected by the vehicle speed sensor 40 is not more than a predetermined value (e.g., 5 km/h), that the engine rotating speed detected by the ignition pulser 30 is not more than a predetermined value (e.g., 2000 rpm), and that the throttle position is not more than a predetermined value (e.g., five degrees). Then, the engine E can be restarted when the throttle position reaches or exceeds a predetermined value during the idle stop.

Furthermore, the ECU 80, in accordance with an embodiment of the invention, can be configured to perform an "idle stop starting time rewind control" in which, at the time of stopping the engine E when the above-mentioned idle stop condition is satisfied, the crankshaft 51 can be reversely rotated from the position where it is stopped to a predetermined position. Hence, the engine E can be rewound to the predetermined position, whereby the approach-run period can be prolonged until coming to the compression top dead center and the startability at the time of restarting the engine E can be enhanced. Incidentally, this rewind control is not carried out in the case where the engine E is stopped by turning off the main switch 45.

An engine starting status decision unit 84 can be configured to determine whether the starting of the engine E is about to be conducted by operating the starting switch 35. Hence, the engine E can be started from a fully stopped state, or the engine E can be restarted from an idle stop state in response to a throttle operation. Then, when it is decided that the engine E is about to be started from the fully stopped state, a duty ratio at the time of reversely rotating the ACG starter motor 70 under the swing-back control can be set by a swing-back reverse-rotation duty ratio setting unit 92 included in the swing-back control unit 90.

On the other hand, when it is decided by the engine starting status decision unit 84 that the engine E is about to be restarted from the idle stop state, a duty ratio at the time of reversely rotating the ACG starter motor 70 for the rewind control can be set by a rewind reverse-rotation duty ratio setting section 101 included in the idle stop starting time rewind control unit 100. Incidentally, the idle stop starting time rewind control unit 100 can include a timer 102 for detecting various kinds of predetermined periods of time.

Then, a drive control unit 85 can be configured to supply, at the time of the swing-back control, driving pulses with the duty ratio set by the swing-back control unit 90 to the power FETs in the full-wave rectification bridge circuit 81. Alternatively, at the time of the rewind control, driving pulses with the duty ratio set by the idle stop starting time rewind control unit 100 can be supplied to the power FETs in the full-wave rectification bridge circuit 81. The engine start control system (ECU) 80, in accordance with an embodiment of the invention, can be configured to set the duty ratio at the time of the swing-back control and the duty ratio at the time of the rewind control to be different from each other. Specifically, the reverse-rotation duty ratio at the time of the rewind control can be set to be lower than the reverse-rotation duty ratio at the time of the swing-back control (for instance, the duty ratio is 100% at the time of the swing-back control, and 45% at the time of the rewind control). Now, the swing-back control and the rewind control will be described in detail below, referring to FIGS. 5 to 8.

Figure 5:
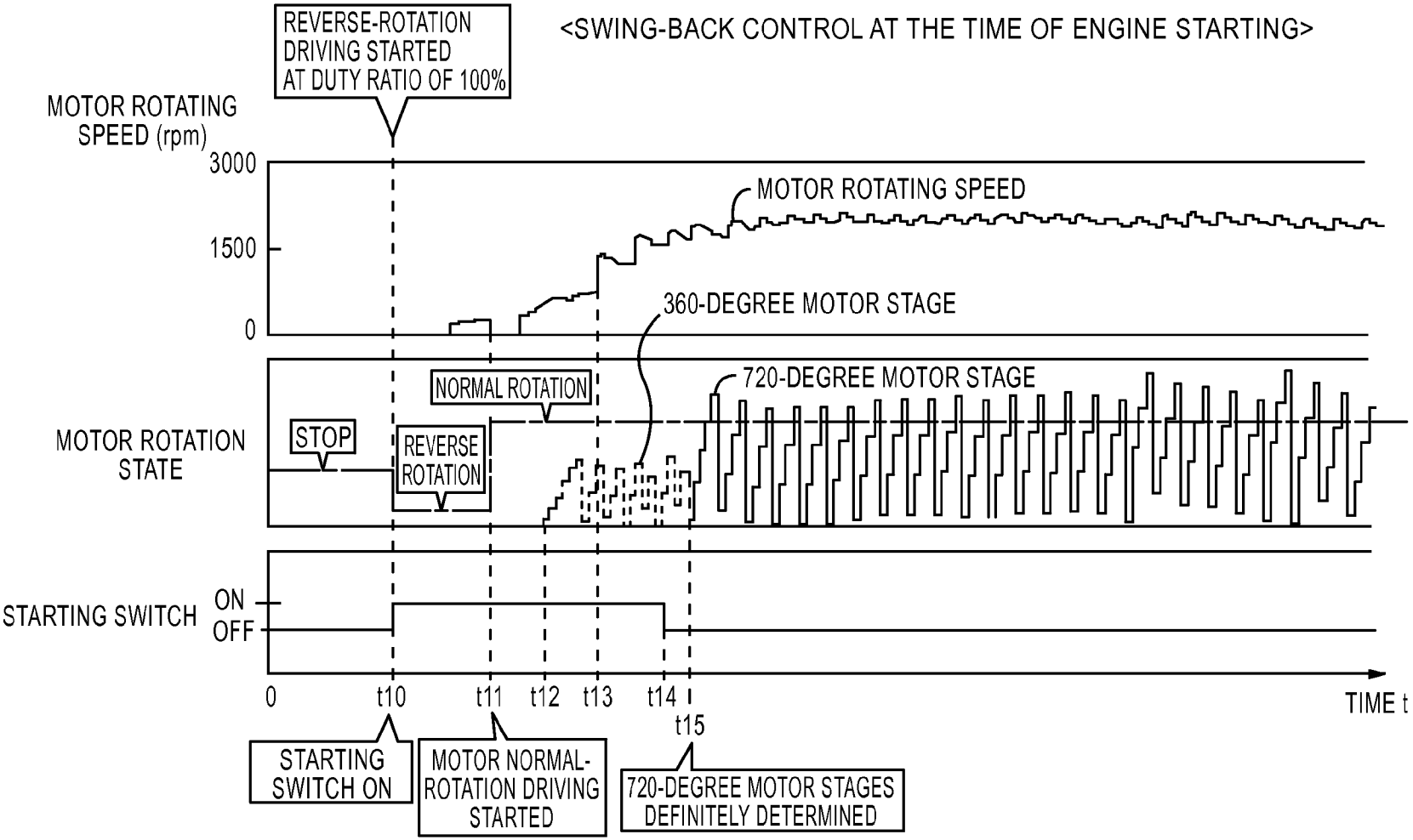
FIG. 5 is a time chart illustrating the flow of swing-back control at the time of starting the engine, in accordance with an embodiment of the invention.

FIG. 5 is a time chart illustrating the flow of swing-back control at the time of starting the engine E, in accordance with an embodiment of the invention. In the chart, motor rotating speed, motor rotation state, and starting switch operation state are illustrated, in this order from the upper side. When the starting switch 35 is turned ON at time t10 starting from the condition where the engine E is in a fully stopped state (i.e., not restarting from an idle stop state), the swing-back control unit 90 can be configured to start reverse-rotation driving of the ACG starter motor 70 at a duty ratio of 100%.

Next, at time t11, normal-rotation driving at a duty ratio of 100% can be started. Then, at time t13, the engine E can be started, the rotating speed of the ACG starter motor 70 can become higher than the driving speed by current passage control, and accordingly, the current passage can be stopped. At time t14, the starting switch 35 can be turned OFF by the rider who has confirmed the starting of the engine E. Incidentally, as for the motor stages, detection of 360-degree motor stage can be started at time t12. Thereafter, when stroke discrimination is completed at time t15, 720-degree motor stages can be definitely determined.

Figure 6:
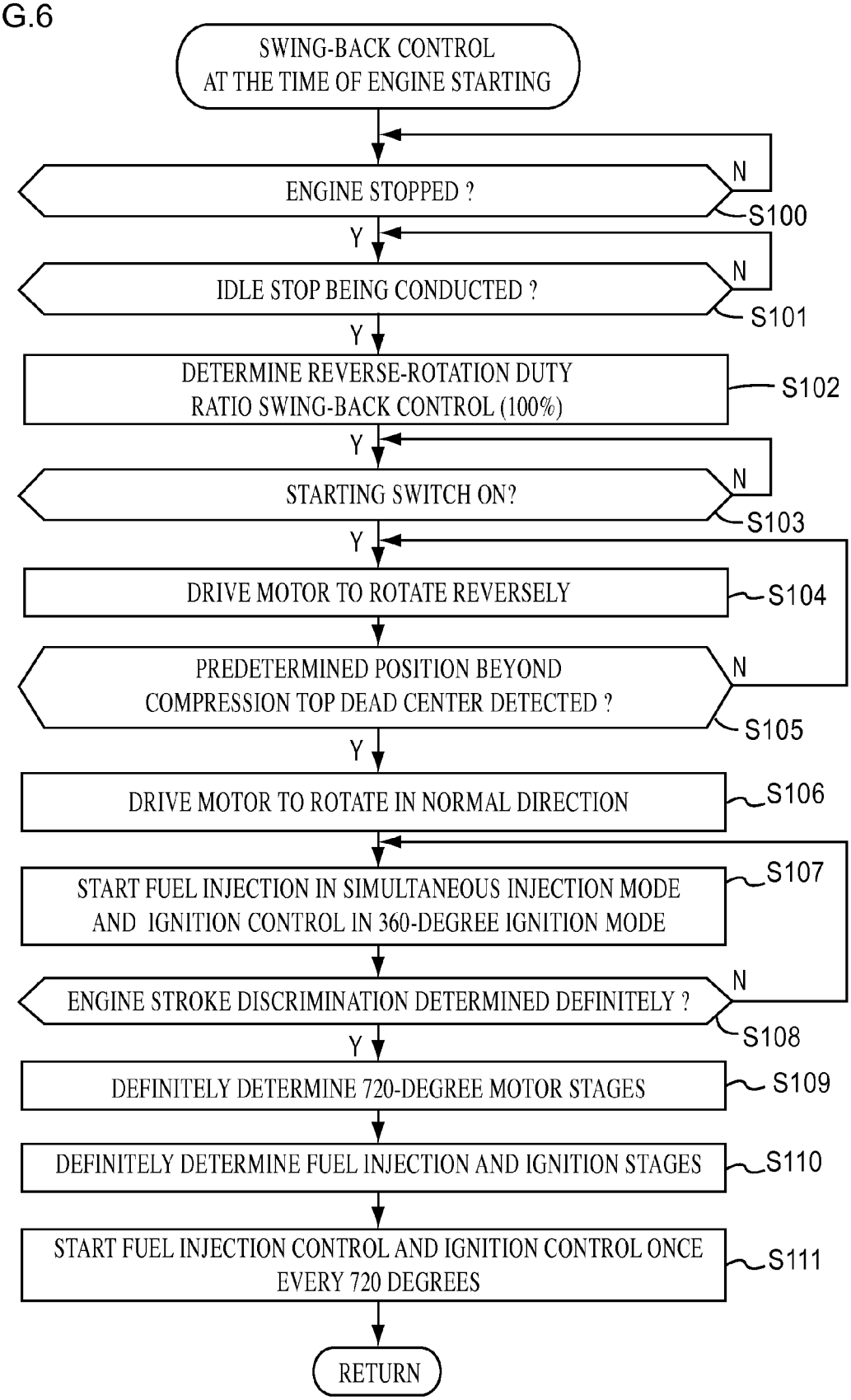
FIG. 6 is a flowchart illustrating the procedure of the swing-back control at the time of starting the engine, in accordance with an embodiment of the invention.

FIG. 6 is a flowchart illustrating the procedure of a swing-back control at the time of starting the engine E, in accordance with an embodiment of the invention. In step S100, it can be decided whether or not the engine E is at stop. When the result of decision in step S100 is affirmative, the control can proceed to step S101, in which it can be decided whether or not the engine E is in an idle stop. When the decision in step S101 is affirmative, the control can proceed to step S102, where a reverse-rotation duty ratio for swing-back control (100%) can be determined. Incidentally, when the decision in each of steps S100 and S101 is negative, the control can return to the relevant decision. In the subsequent step S103, it can be decided whether or not the starting switch 35 has been turned ON. When the decision is affirmative, the control can proceed to step S104, whereas when the decision is negative, the control can return to decision in step S103.

In step S104, reverse-rotation driving of the ACG starter motor at a duty ratio of 100% can be started. In the subsequent step S105, it can be decided whether or not a predetermined position beyond the compression top dead center is detected. The predetermined position here may for example be set to be a position of 30 degrees beyond the compression top dead center. When the decision in step S105 is affirmative, the control can proceed to step S106, in which normal-rotation driving of the ACG starter motor 105 at a duty ratio of 100% can be started. Incidentally, when the decision in step S105 is negative, the control can return to S104.

Next, in step S107, simultaneous fuel injection for injecting a fuel every two revolutions of the crankshaft at a preset stage of the 360-degree motor stages and 360-degree ignition for performing ignition every one revolution of the crankshaft at a preset stage of the 360-degree motor stages can be started. In step S108, it can be decided whether or not stroke discrimination (discrimination of each of intake, exhaust, compression, and combustion strokes of the engine corresponding to a crank angle of 720 degrees) for the engine E is completed by use of an output of the PB sensor during two revolutions of the crankshaft. When the decision result is affirmative, 720-degree motor stages can be determined in step S109, and fuel injection and ignition stages can be determined in step S110. Then, ignition control and fuel injection control conducted once per 720 degrees (once per two revolutions of the crankshaft) can be started in step S111, and a series of control can be finished. Incidentally, when the decision in step S108 is negative, the control can proceed back to step S107.

As previously described, in the engine start control system, in accordance with an embodiment of the invention, the duty ratio for reverse-rotation driving can be set to 100% at the time of swing-back control, whereby the reverse-rotation driving as preparation for normal-rotation driving can be completed in a period of time as short as possible. On the other hand, in rewinding at the time of starting an idle stop, normal-rotation driving is not conducted continuously after reverse-rotation driving, so that no problem would be generated even if reverse rotation is conducted at a low speed, for example, at a duty ratio of 45%. Besides, according to the rewind control at the time of starting the idle stop which will be described below, the reverse-rotation speed at the time of rewinding can be lowered, whereby it is possible to prevent an excessive return in the normal direction from the compression top dead center from occurring, and can reduce the influence of a compression reaction force at the time of reverse rotation, thereby swiftly stopping the crankshaft 51 at an optimum position for restarting. Incidentally, the preset respective duty ratios may be corrected according to engine cooling water temperature.

Figure 7:
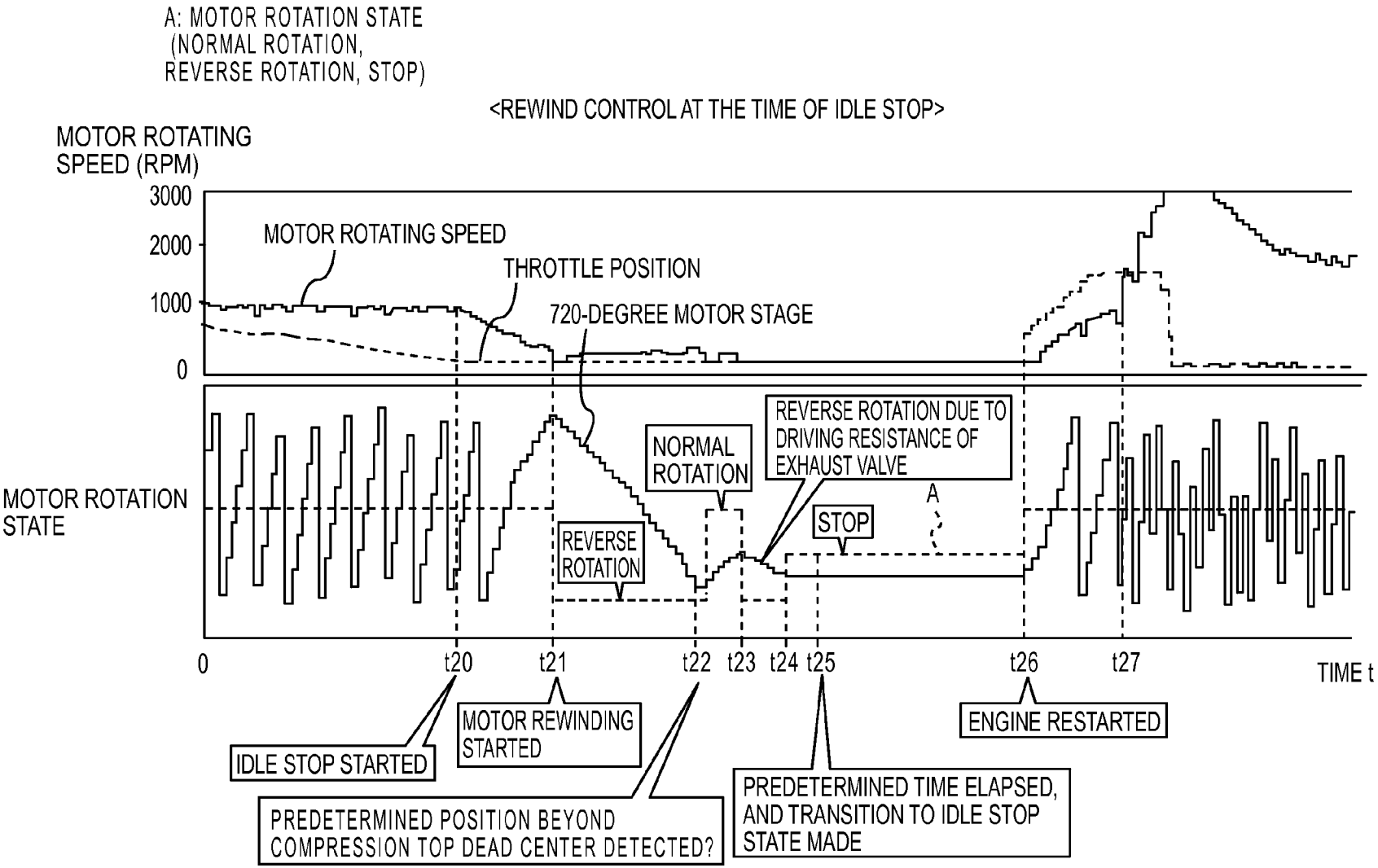
FIG. 7 is a time chart illustrating the flow of rewind control at the time of starting an idle stop, in accordance with an embodiment of the invention.

FIG. 7 is a time chart illustrating the flow of rewind control at the time of starting an idle stop, in accordance with an embodiment of the invention. In the chart, motor rotating speed, throttle position, and motor rotation state are illustrated, in this order from the upper side. At time t20, the above-mentioned idle stop condition can be satisfied, and idle stop control can be started. Thereafter, when it is detected at time t21 that the crankshaft 51 is stopped, rewind control at a duty ratio of 45% can be started.

At time t22, the crankshaft 51 can approach the compression top dead center in the reverse direction, and the compression reaction force on the piston can be enhanced, whereby the piston can be pushed backward in the condition where reverse-rotation current passage at the duty ratio of 45% can be continued with the result that the crankshaft 51 is shifted into normal rotation. Hence, swinging back of the crankshaft 51 can be started. When it is detected, based on an output signal from the motor angle sensor 29, that the ACG starter motor 70 has started rotating in normal direction, the idle stop starting time rewind control unit 100 can be configured to determine whether the crankshaft 51 has reached a predetermined position beyond the compression top dead center, can be configured to stop the current supply to the ACG starter motor 70, and can be configured to start counting a predetermined swinging-back waiting time by the timer 102 (see FIG. 4).

Subsequently, during the period from time t23 to time t24, the crankshaft 51 can be reversely rotated due to an exhaust valve driving resistance, and can be stopped at time t24. Then, at time t25, the time having been counted by the timer 102 can reach the predetermined swinging-back waiting time, resulting in transition to the idle stop state.

Thereafter, at time t26, it can be detected that the throttle position has reached or exceeded a predetermined value due to a throttle operation by the rider, and normal-rotation driving at a duty ratio of 100% can be started for the purpose of restarting the engine. Then, at time t27, the engine can be started, whereby its rotating speed can be made to exceed the driving rotating speed of the ACG starter motor 70, and the restarting is completed.

Incidentally, the predetermined position beyond the compression top dead center mentioned above can also be detected based on a change (deceleration) in the passing speed of the 720-degree motor stage obtained by equally dividing two revolutions of the crankshaft 51 by the 72 motor stages. The passing speed of the stages can be obtained by counting the passing time of each stage. Incidentally, while the details of the 720-degree motor stages will be described later, the detection of the predetermined position beyond the compression top dead center during reverse-rotation driving in the above-mentioned swing-back control can also be carried out in the case where the 720-degree motor stage has reached a predetermined stage, or based on a change in the passing speed of the 720-degree motor stage.

Figure 8:
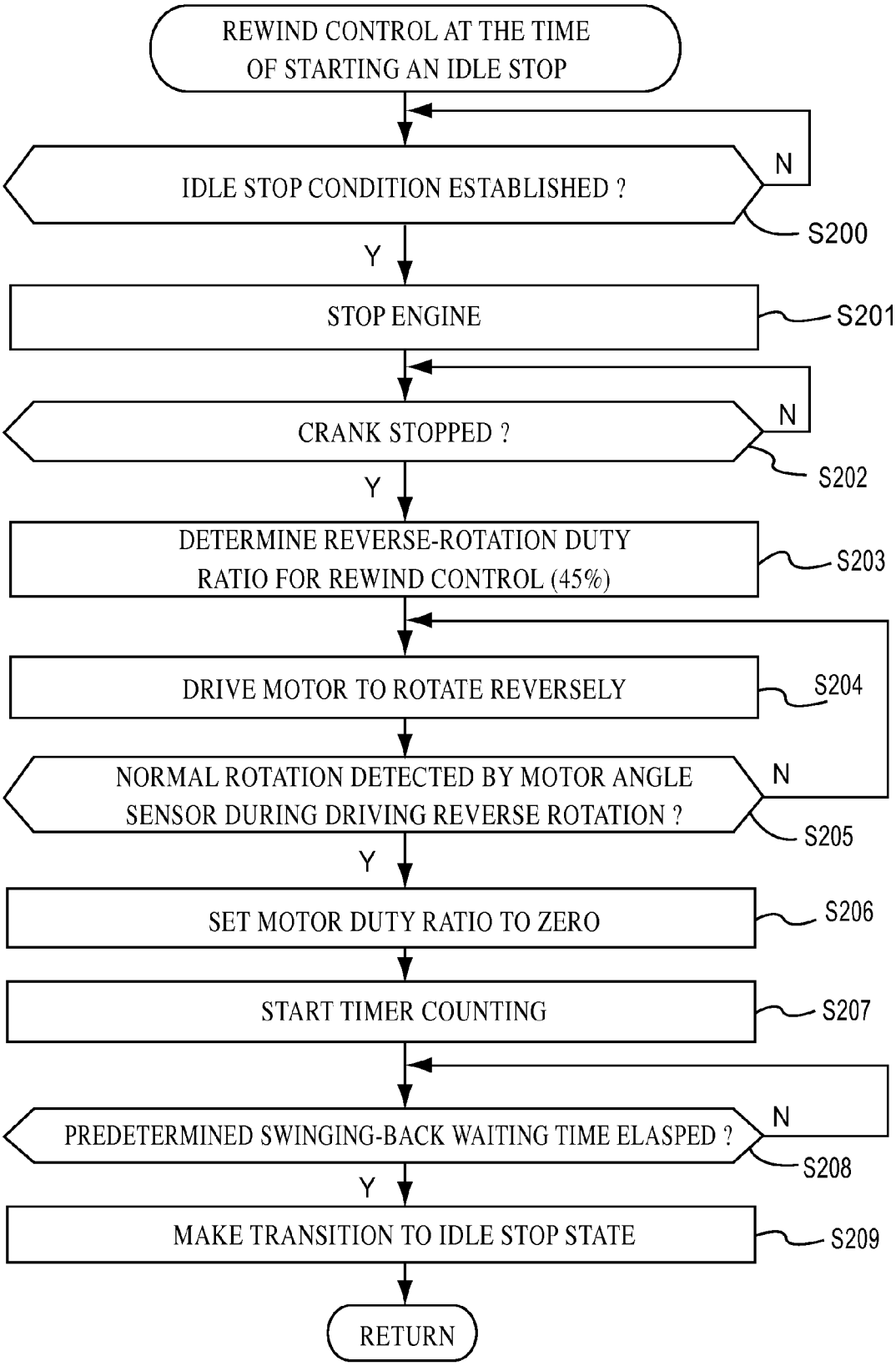
FIG. 8 is a flowchart illustrating the procedure of the rewind control at the time of starting the idle stop, in accordance with an embodiment of the invention.

FIG. 8 is a flowchart illustrating the procedure of rewind control at the time of starting an idle stop, in accordance with an embodiment of the invention. In step S200, it can be decided whether or not an idle stop condition is established. When the decision is affirmative, the control can proceed to step S201, in which a stopping processing of the engine E is performed. Incidentally, when the decision in step S200 is negative, the control can return to step S200.

Next, in step S202, it can be decided, based on an output signal from the motor angle sensor 29, whether or not the rotation of the crankshaft 51 is stopped. When the decision in step S202 is negative, the control can return to step S202. On the other hand, when the decision is affirmative, the control can proceed to step S203, in which a motor duty ratio for rewind control (45%) is determined. In the subsequent step S204, reverse-rotation driving at a duty ratio of 45% can be started. In step S205, it can be decided whether or not normal rotation is detected by the motor angle sensor 29, and when the decision is affirmative, the control can proceed to step S206. When the decision in step S205 is negative, the control can return to step S204. In step S206 to which the control proceeds upon detection of normal rotation of the crankshaft 51, the motor duty ratio can be set to zero. Hence, the current supply to the ACG starter motor 70 can be stopped. In the subsequent step S207, counting of a predetermined swinging-back waiting time (e.g., two seconds) by the timer 102 can be started. Then, in step S208, it can be decided whether or not the predetermined swinging-back waiting time has elapsed. When the decision is negative, the control can return to the decision in step S208. On the other hand, when the decision is affirmative, the control can proceed to step S209, in which transition to an idle stop state can be made, whereby a series of control can be finished.

Figure 9:
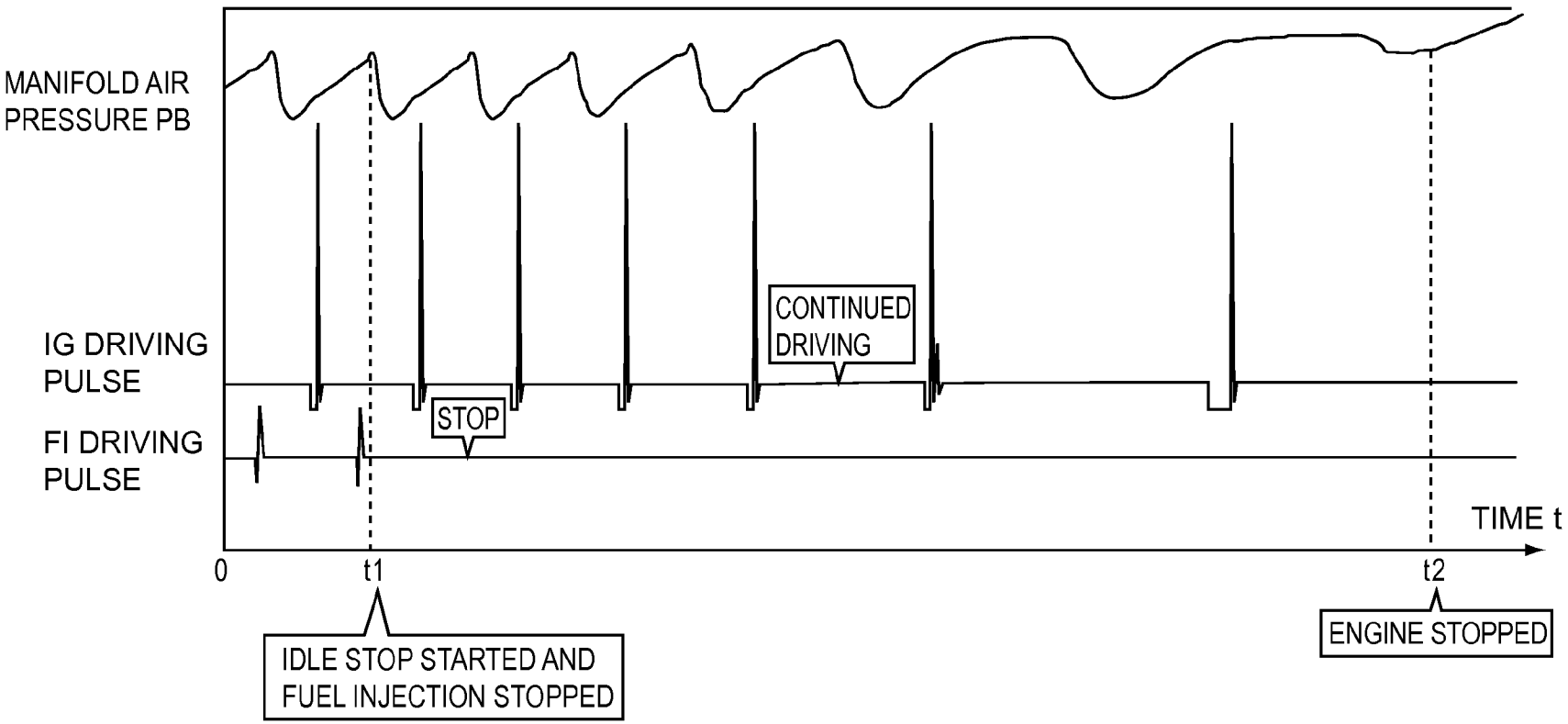
FIG. 9 is a graph illustrating the drive conditions of a fuel injection system and an ignition device at the time of starting the idle stop, in accordance with an embodiment of the invention.
Figure 10:
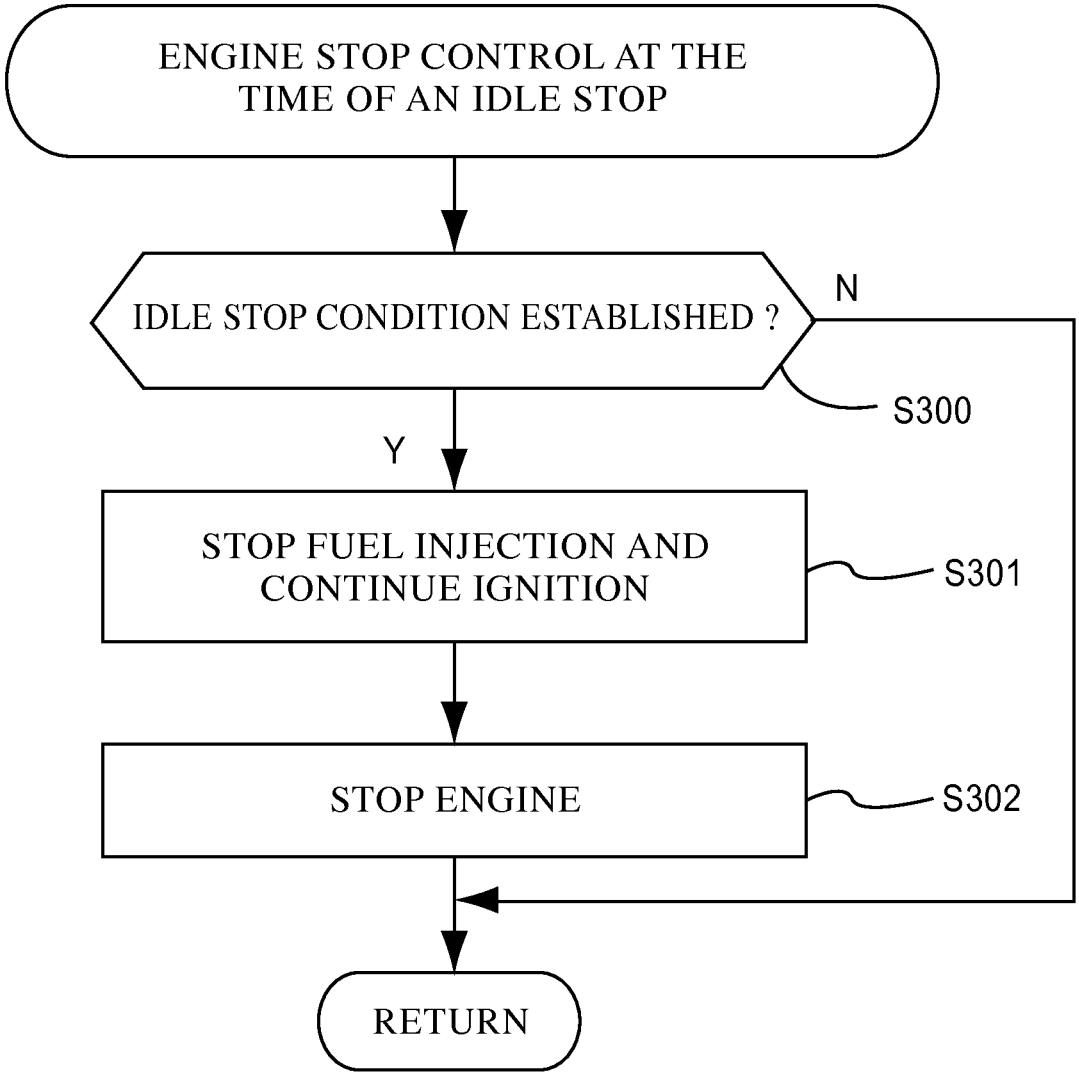
FIG. 10 is a flowchart illustrating the procedure of fuel injection and ignition control at the time of staring the idle stop, in accordance with an embodiment of the invention.

FIG. 9 is a graph illustrating the drive conditions of the fuel injection system 28 and the ignition device (spark plug 22) at the time of starting an idle stop, in accordance with an embodiment of the invention. In the diagram, the value of manifold air pressure measured by the PB sensor and driving pulses for the ignition device and the fuel injection system are illustrated, in this order from the upper side. In addition, FIG. 10 is a flowchart illustrating the procedure of engine stop control at the time of starting the idle stop, in accordance with an embodiment of the invention.

In the engine start control system, in accordance with an embodiment of the invention, at the time of starting the idle stop, only fuel injection is stopped and an igniting operation can be continued as it is. Referring to FIG. 10, in step S300, it can be decided whether or not the idle stop condition is established. When the decision is affirmative, the control can proceed to step S301. Incidentally, if the decision in step S300 is negative, the control can be finished. In step S301, fuel injection by the fuel injection device 28 can be stopped, and ignition by the spark plug 22 is continued as it is. When the engine is stopped (the rotation of the crankshaft 51 is stopped) in step S302, a series of control can be finished. According to the configuration as previously discussed, even if unburned gas should be remaining in a combustion chamber of the engine E or the like at the time of starting the idle stop, it would be possible to completely combust the unburned gas until the crankshaft 51 is stopped.

Meanwhile, the driving of the fuel injection system and the ignition device at the time of starting the engine has been carried out as follows. During the period after engine stroke discrimination is completed and until the 720-degree motor stages are definitely determined, simultaneous fuel injection for performing one time the fuel injection when the engine rotating speed has reached or exceeded a predetermined value is conducted. Thereafter the fuel injection is conducted at a timing based on a predetermined crank angle, and fixed ignition is carried out one time every one revolution (360 degrees) of the crankshaft. Therefore, even in the case of restarting the engine from the engine stop state due to the idle stop, the simultaneous fuel injection and the fuel injection at the timing based on a predetermined crank angle and the 360-degree ignition have been carried out until the stroke discrimination is finished.

In contrast, in the engine start control system, in accordance with an embodiment of the invention, the 720-degree motor stage determined before starting the idle stop can be stored even during the idle stop so that the fuel injection and ignition control based on the 720-degree motor stage can be carried out from the beginning without performing the stroke discrimination at the time of restarting the engine. Now, this will be described in detail below, referring to FIGS. 11 to 13.

Figure 11:
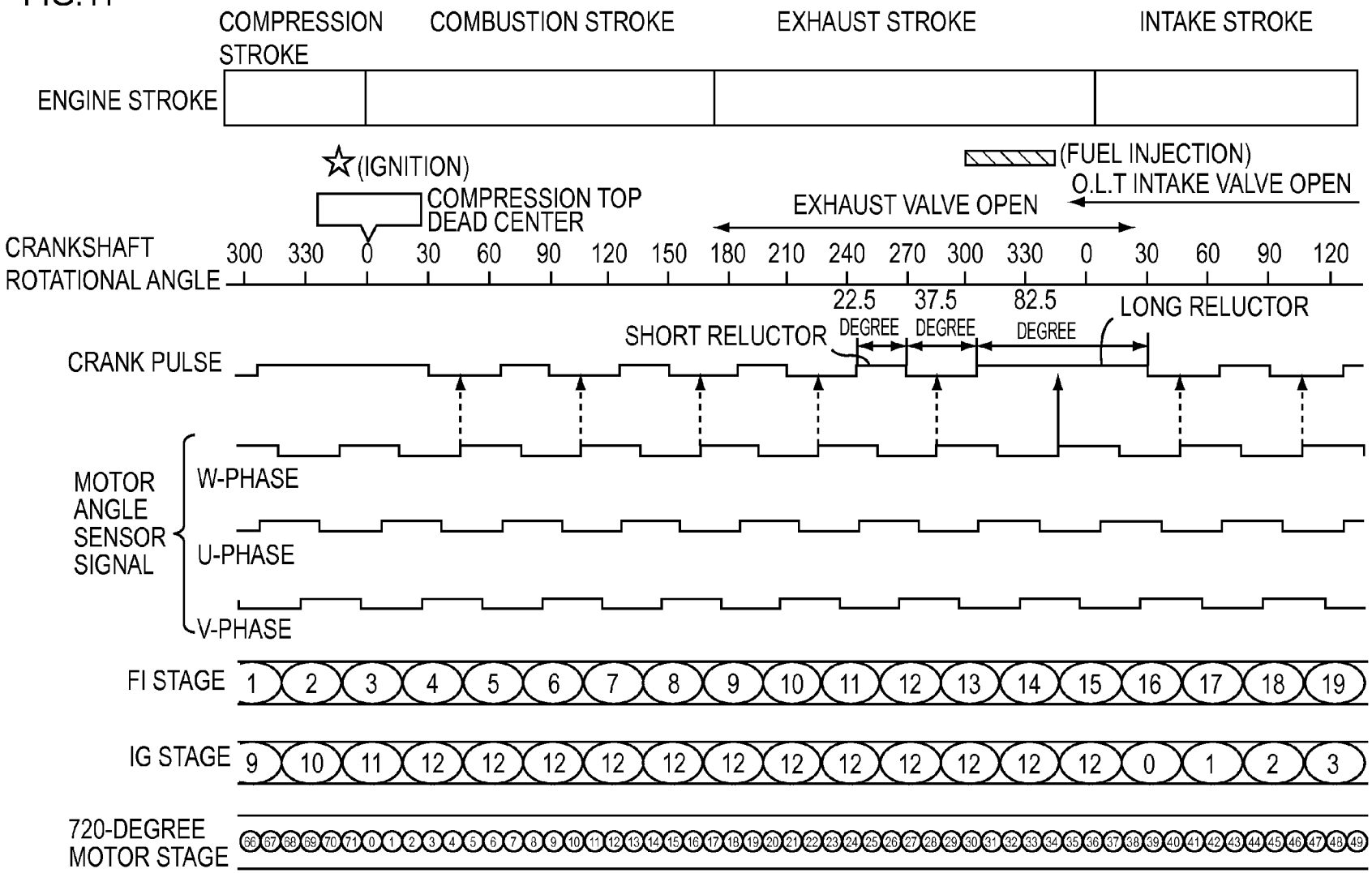
FIG. 11 is a timing chart illustrating the relationships of the rotational angle of a crankshaft with 720-degree motor stages, in accordance with an embodiment of the invention.

FIG. 11 is a timing chart illustrating the relationships of the rotational angle of the crankshaft 51 with 720-degree motor stages, in accordance with an embodiment of the invention. In the chart, four strokes (compression, combustion, exhaust, and intake strokes) of the four-cycle engine, crankshaft rotational angle, crank pulse, an output signal (W-phase, U-phase, and V-phase) from the motor angle sensor 29, fuel injection (FI) stages as reference for driving timing of the fuel injection system, ignition (IG) stages as reference for driving timing of the ignition device, and 720-degree motor stages are illustrated, in this order from the upper side.

The 720-degree motor stages can be obtained by allocating the period of two revolutions (720 degrees) of the crankshaft to a total of 72 stages including Stages #0 to #71, with each stage being 10 degrees long. In addition, the motor angle sensor 29 can be configured so that the W-phase, U-phase and V-phase output respective pulse signals have a width of 30 degrees at intervals of 30 degrees with each phase staggered from one another by 10 degrees. This ensures that the rotational angle of the crankshaft 51 can be detected in increments of 10 degrees, and a reference position therefor can be determined by a crank pulse signal. A pulser rotor can be mounted to the crankshaft 51 for the purpose of detecting the crank pulse signal has such a shape that four short reluctors having a detection width of 22.5 degrees in the circumferential direction and one long reluctor having a detection width of 82.5 degrees in the circumferential direction are arranged at intervals of 37.5 degrees. The output of the W-phase can be configured to output a signal at a central position of the long reluctor and can be configured to serve as a reference for deducing the crank rotational angle.

Then, the 360-degree motor stages can be determined by a crank pulse signal and a rotor sensor signal. In an intake stroke on the obverse side, the PB value (the value of an output from the PB sensor) can become smaller. In the combustion stroke on the reverse side after 360-degree rotation, obverse/reverse decision, based on the absence of intake and an increase in the PB value, can be conducted, whereby the obverse/reverse decision as to two revolutions of the crankshaft is definitely determined, whereon 720-degree motor stages can be determined. For instance, the position of 30 degrees before the compression top dead center mentioned above can be detected due to the 720-degree motor stage being #69. Incidentally, ignition can be conducted in an IG stage range of 9 to 11, and fuel injection can be conducted in an FI stage range of 12 to 17.

Figures 12, 13:
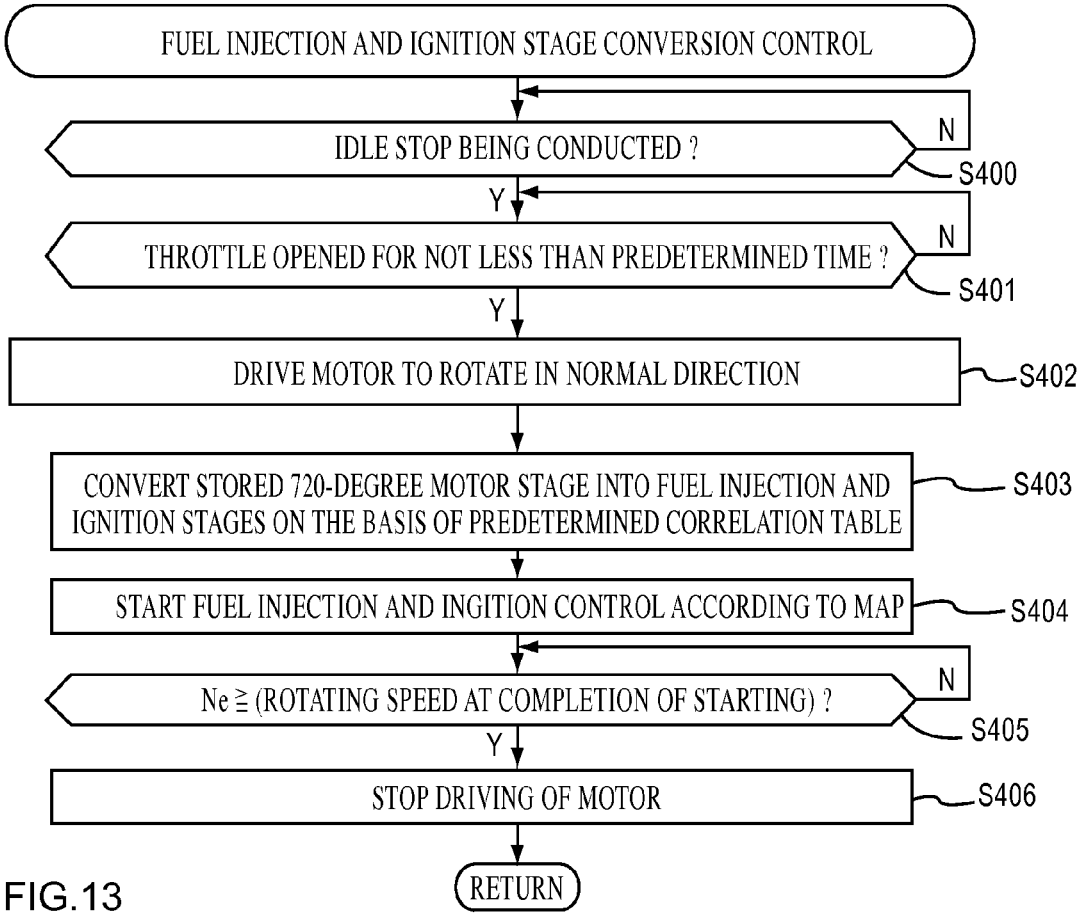
FIG. 12 is a flowchart illustrating the procedure of a fuel injection and ignition stage conversion control, in accordance with an embodiment of the invention.
FIG. 13 is a correlation table illustrating correlations of 720-degree motor stages with fuel injection stages and ignition stages, in accordance with an embodiment of the invention.

FIG. 12 is a flowchart illustrating the procedure of a fuel injection and ignition stage conversion control, in accordance with an embodiment of the invention. In step S400, it can be decided whether or not an idle stop is being conducted. When the decision is affirmative, the control can proceed to step S401, in which it is decided whether or not the throttle is opened to or in excess of a predetermined position. When this decision is affirmative, the control can proceed to step S402. Incidentally, when the decision result of each of steps S400 and S401 is negative, the control can return to the relevant decision.

In step S402, the ACG starter motor 70 can be driven to rotate in normal direction for the purpose of restarting the engine. Then, in step S403, based on the 720-degree motor stage at the time of starting of the idle stop which is stored in the 720-degree motor stage storage means 111, a fuel injection and ignition stage correlation table 112, as illustrated in FIG. 13, can be referred to so as to deduce an FI stage and an IG stage. For example, when the 720-degree motor stage is in the range of #2 to #4, it can be converted into an FI stage of #4 and an IG stage of #12. Incidentally, since current supply to the ECU 80 is continued during the idle stop, the 720-degree motor stage storage means 111 can be composed of a RAM in which the stored contents are reset in response to turning-OFF of the power supply.

In step S404, driving of the fuel injection system and the ignition device based on the FI stage and IG stage, which are ascertained in step S403 and on a fuel injection map and an ignition map which are predetermined, can be started. Incidentally, the fuel injection map can be composed of a map for determining a fuel injection time based on engine rotating speed Ne, throttle position θ, manifold air pressure detected by the PB sensor, etc. Then, in step S405, it can be decided whether or not the engine rotating speed (motor rotating speed) Ne has reached or exceeded a start completion rotating speed (e.g., 1000 rpm). When the decision result is negative, the control can return to the decision in step S405. On the other hand, when the decision in step S405 is affirmative, the control can proceed to step S406, in which the driving of the ACG starter motor 70 is stopped, whereby a series of control can be finished.

Thus, according to embodiments of the invention, as described for the fuel injection and ignition stage conversion control, at the time of restarting the engine from the idle stop, it may be unnecessary to perform engine stroke discrimination. Optimum fuel injection and ignition control based on 720-degree motor stages can be carried out from the beginning, so that startability at the time of restarting the engine can be enhanced. In addition, since simultaneous fuel injection is not conducted, fuel economy can be improved.

Incidentally, the shapes and structures of the ACG starter motor, the pulser rotor, and the motor angle sensor, the inside configuration of the ECU (engine start control system), the respective reverse-rotation duty ratios in swing-back control and idle stop starting time rewind control, the correlation of 720-degree motor stages with fuel injection and ignition stages, etc. are not limited to those illustrated for the above embodiments, and various modifications thereof are possible. For instance, according to the above-described embodiments, the swing-back control at the time of starting the engine, the rewind control at the time of starting an idle stop, the fuel injection stop and ignition continuation control at the time of starting the idle stop, and the fuel injection and ignition stage conversion control at the time of restarting the engine from the idle stop state can be applied in combinations of them. The engine start control system, in accordance with an embodiment of the invention, can be applicable not only to motorcycles, but also to three-wheel vehicles, four-wheel vehicles, and the like.

DESCRIPTION OF REFERENCE NUMERALS

1 Motorcycle
21 Ignition coil (Ignition device)
22 Spark plug (Ignition device)
28 Fuel injection system
29 Motor angle sensor
30 Ignition pulser
51 Crankshaft
70 ACG starter motor (Motor)
80 ECU (Engine start control system)
81 Full-wave rectification bridge circuit
90 Swing-back control unit
91 Swing-back reverse-rotation duty ratio setting section
100 Idle stop starting time rewind control unit
101 Rewind reverse-rotation duty ratio setting section
102 Timer
110 Restarting time motor stage conversion means
111 720-degree motor stage storage means
112 Fuel injection and ignition stage correlation table

We claim:

1. An engine start control system, comprising:

an idle stop control configured to stop an engine upon establishment of a predetermined condition and configured to restart, by a throttle operation at the time of starting the engine, using a starting switch;

a fuel injection system configured to perform simultaneous fuel injection until completion of a stroke discrimination;

an ignition device configured to ignite at a preset fixed timing every one revolution of a crankshaft; and a storage unit configured to store, during execution of the idle stop control, a result of the stroke discrimination after initiating the engine starting, wherein, after completion of the stroke discrimination, the engine start control system is configured to perform a fuel injection and ignition control once every two revolutions of the crankshaft based on an output value of a lead (Pb) sensor, and wherein, at the time of restarting the engine by the idle stop control, the result of the stroke discrimination stored in the storage unit is used to drive the fuel injection system and the ignition device, instead of conducting a new stroke discrimination.

2. The engine start control system according to claim 1, further comprising:

a stage decision unit configured to allocate a period of two revolutions of the crankshaft to a plurality of motor stages set at regular intervals based on the result of the stroke discrimination;

a correlation table configured to predetermine correlations of the plurality of motor stages with fuel injection stages to be used for driving the fuel injection system and ignition stages to be used for driving the ignition device; and a stage converter configured to convert a motor stage into a fuel injection stage and an ignition stage at the time of restarting the engine after the idle stop by the idle stop control.

3. The engine start control system according to claim 2, wherein a length of one period of the motor stage is set to be shorter than the length of one period of the fuel injection stage.

4. The engine start control system according to claim 1, further comprising:

an idle stop starting time rewind control unit configured to rewind the crankshaft of the engine to a predetermined position beyond a compression top dead center, when the engine is stopped by the idle stop control.

5. The engine start control system according to claim 1, further comprising:

a motor, wherein the motor comprises an alternating-current generating starter motor configured to function as both a starter motor and an alternating-current generator.

6. The engine start control system according to claim 1, wherein, at the time of restarting the engine from the idle stop control, the engine start control system is further configured to perform a fuel injection and ignition control once every two revolutions of the crankshaft.

7. The engine start control system according to claim 1, wherein the engine control system is configured to process the stroke discrimination by discriminating an intake stroke and a combustion stroke from each other based on the fact that an intake pressure value detected by a intake pressure sensor is lowered due to a manifold air pressure in the intake stroke, and further configured to raise the stroke discrimination due to the non-execution of intake in the combustion stroke after a 360-degree rotation.

8. An engine start control system, comprising:

idle stop controlling means for stopping an engine upon establishment of a predetermined condition and configured to restart, by a throttle operation at the time of starting the engine, using a starting switch;

fuel injecting means for performing a simultaneous fuel injection until completion of a stroke discrimination;

igniting means for igniting at a preset fixed timing every one revolution of a crankshaft; and storing means for storing, during execution of the idle stop controlling means, a result of the stroke discrimination after initiating the engine starting, wherein, after completion of the stroke discrimination, the engine start control system is configured to perform a fuel injection and ignition control once every two revolutions of the crankshaft based on an output value of a lead (Pb) sensor, and wherein, at the time of restarting the engine by the idle stop controlling means, the result of the stroke discrimination stored in the storage unit is used to drive the fuel injection means and the ignition means, instead of conducting a new stroke discrimination.

9. A method, comprising:

stopping an engine upon establishment of a predetermined condition;

restarting, by a throttle operation at the time of starting the engine, using a starting switch;

performing simultaneous fuel injection until completion of a stroke discrimination;

igniting at a preset fixed timing every one revolution of a crankshaft;

storing, during execution of the idle stop control, a result of the stroke discrimination after initiating the engine starting;

after completion of the stroke discrimination, performing a fuel injection and ignition control once every two revolutions of the crankshaft based on an output value of a lead (Pb) sensor; and at the time of restarting the engine by the idle stop control, using the result of the stroke discrimination stored in the storage unit to drive the fuel injection system and the ignition device, instead of conducting a new stroke discrimination.

10. The method according to claim 9, further comprising:

allocating a period of two revolutions of the crankshaft to a plurality of motor stages set at regular intervals based on the result of the stroke discrimination;

predetermining correlations of the plurality of motor stages with fuel injection stages to be used for driving the fuel injection system and ignition stages to be used for driving the ignition device; and converting a motor stage into a fuel injection stage and an ignition stage at the time of restarting the engine after the idle stop by the idle stop control.

11. The method according to claim 10, further comprising:

setting a length of one period of the motor stage to be shorter than the length of one period of the fuel injection stage.

12. The method according to claim 9, further comprising:

rewinding the crankshaft of the engine to a predetermined position beyond a compression top dead center, when the engine is stopped by the idle stop control.

13. The method according to claim 9, further comprising:

at the time of restarting the engine from the idle stop control, performing a fuel injection and ignition control once every two revolutions of the crankshaft.

14. The method according to claim 9, further comprising:

processing the stroke discrimination by discriminating an intake stroke and a combustion stroke from each other based on the fact that an intake pressure value detected by a intake pressure sensor is lowered due to a manifold air pressure in the intake stroke; and raising the stroke discrimination due to the non-execution of intake in the combustion stroke after a 360-degree rotation.

* * * * *